United States Patent [19]

Sato et al.

[11] Patent Number: 4,919,189

[45] Date of Patent: Apr. 24, 1990

[54] METHOD OF FORMING AS-CAST HOLES BY USING CORES, AND APPARATUS FOR PRACTICING THE METHOD

[75] Inventors: Keiji Sato; Yasutaka Nakatsukasa, both of Hiroshima, Japan

[73] Assignee: Ryobi Ltd., Hiroshima, Japan

[21] Appl. No.: 247,146

[22] Filed: Sep. 21, 1988

[30] Foreign Application Priority Data

Sep. 21, 1987 [JP] Japan ..... 62-237882
Dec. 16, 1987 [JP] Japan ..... 62-319260

[51] Int. Cl.[5] ..... B22D 33/04

[52] U.S. Cl. ..... 164/137; 164/340; 249/64; 249/145; 249/151; 249/184

[58] Field of Search ..... 164/137, 340, 342, 343; 249/64, 145, 151, 176, 184

[56] References Cited

U.S. PATENT DOCUMENTS 3,433,292 3/1969 McDonald ..... 164/343
4,206,799 6/1980 McDonald ..... 164/343

FOREIGN PATENT DOCUMENTS 58-6610 2/1983 Japan .

*Primary Examiner*—Richard K. Seidel
*Attorney, Agent, or Firm*—Sughrue, Mion, Zinn, Macpeak & Seas

[57] ABSTRACT

A method for forming an as-cast hole by using a core involves forming an undercut and casting by using a core die which is slidable at an angle with respect to mold closing and opening directions. At the same time, an as-cast hole with an axial direction different from the slide direction of the core die is formed. To form the as-cast hole, a floating core is slidably disposed in the core die for movement in the axial direction of the as-cast hole. An apparatus for practicing the method includes a stationary die, a movable die and the core die containing the slidable floating core.

13 Claims, 8 Drawing Sheets

METHOD OF FORMING AS-CAST HOLES BY USING CORES, AND APPARATUS FOR PRACTICING THE METHOD

BACKGROUND OF THE INVENTION

This invention relates to a method of forming as-cast holes by using cores in a die-casting mold which is opened and closed using a hydraulic cylinder. This invention also relates to an apparatus for practicing the method.

It has previously been proposed that where a casting is to be formed with a die-casting mold having undercuts or as-cast holes which cannot be formed using only stationary and movable dies, a core which is movable in the direction of formation of the undercuts or as-cast holes be provided in the mold.

For instance in the case of forming a casting a which has undercuts b and j and as-cast holes c and d as shown in FIG. 1(*a*), the undercuts b and j and the as-cast hole c can be formed by sliding a core die e in the directions of the arrow g—g' by use of a hydraulic cylinder. However, it is impossible to form the hole d by using the core die e because the hole d is perpendicular to the directions of the arrow g—g'.

In order to form the hole d, it would be necessary to provide a protrusion e' in the core die e; as shown in FIG. 1(*b*), but since the core die e is moved in the directions of the arrow g—g', such a protrusion is not possible from a practical standpoint.

FIG. 2 shows an example of another proposed method for forming an as-cast hole i. This method involves use of a dual core e and h in which hydraulic cylinder f forms an angle with the directions g—g' for sliding the core die e. However, even in this method, the angle of formation of the hole i with respect to the directions g—g' of the core die e is limited. That is, it is impossible to form an as-cast hole the axis of which forms right angles (or an acute angle close to right angles) with the slide direction g—g'.

Therefore, the as-cast hole d has been formed as follows: The part of the casting where the hole d is to be formed is molded relatively large in wall thickness, and is then machined to form the hole in another manufacturing step. Formation of the hole d is thus troublesome. Moreover, there is a likelihood that cavities will be formed in the casting due to the large wall thickness.

SUMMARY OF THE INVENTION

An object of this invention is to provide an improved method of forming an as-cast hole free of the above-mentioned problems. The improved method uses a core in which a floating core is combined with a core die. The floating core is slidable with the core die but in a direction different from the slide direction of the core die. The structure is such that an undercut and an as-cast hole in the slide direction of the core die and an as-cast hole in a direction perpendicular to the slide direction of the core die are formed simultaneously. A further object of the invention is to provide an apparatus for practicing the method.

More specifically, in the apparatus, a floating core is arranged in a hole formed in a core die which is slidable in a direction different from closing and opening directions of a mold. The structure is such that the floating core is slidable at a desired angle with respect to the slide direction of the core die and can be held between a stationary die and a movable die. The floating core is slidable by two drive mechanisms arranged on both sides of the floating core.

In the method, an as-cast hole is formed using the above apparatus to slide the floating core at a desired angle with respect to the slide direction of the core die and hold it between a stationary die and movable die. The core die is slid to form an as-cast hole and an undercut while the floating core forms an as-cast hole in a direction different from the slide direction of the core die.

DETAILED DESCRIPTION OF THE INVENTION

Preferred embodiments of this invention will be described with reference to the accompanying drawings.

Figure 3:
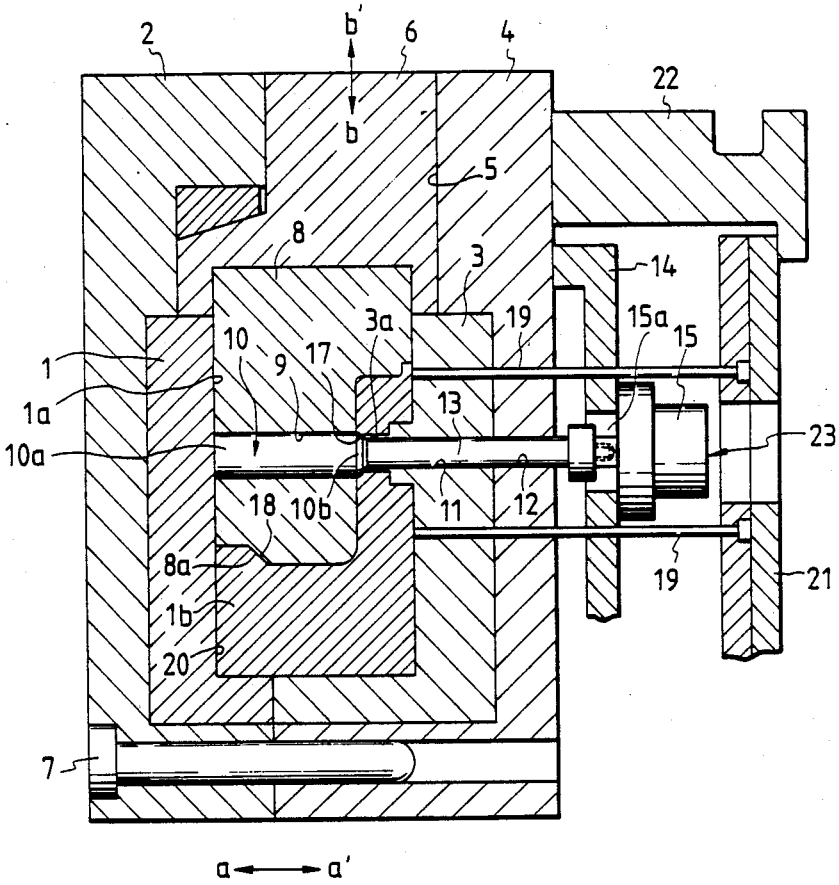
FIG. 3 is a vertical sectional view showing one example of an apparatus for forming an as-cast hole by using a core according to a first aspect of this invention, in which view the mold is closed.
Figure 4:
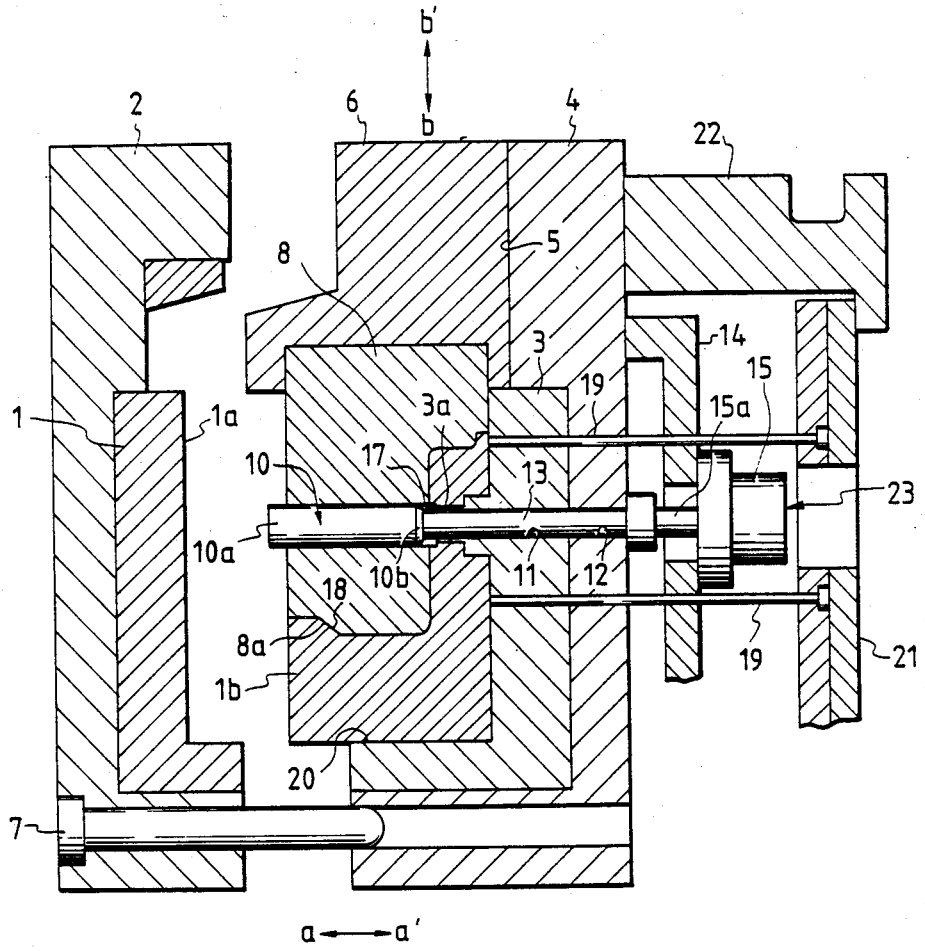
FIG. 4 is a vertical sectional view showing the state of the apparatus when the mold is opened.

An apparatus for forming an as-cast hole by using a core according to a first aspect of the invention will be described with reference to FIGS. 3-5. In these Figures, a stationary die 1 is embedded in a stationary holder 2 and secured thereto with socket screws (not shown). A movable die 3 is embedded in a movable holder 4 and secured thereto with socket screws (not shown).

A groove 5 is formed in the movable holder 4 in such a manner that it extends in a direction perpendicular to the mold opening and closing directions a—a' and communicates with the movable die 3. A core holder 6 is fitted in the groove 5, and is slidable in the directions of the arrow b—b'.

The movable holder 4 is slidably mounted on a plurality of guide pins 7 extending from the stationary holder 2, so that the holder 4 is movable towards or away from the holder 2 in the directions of the arrow a—a', respectively. A hydraulic cylinder (not shown) or the like may be used to move the holder 4 and thereby close or open the mold.

A core die 8 is fixedly secured to an inner end of the core holder 6 with socket screws (not shown). The core die 8 has a through-hole 9 which extends in a direction perpendicular to the arrow b—b'. A floating core 10 is fitted in the through-hole 9 for slidable movement in the directions of the arrow a—a' (hereinafter also referred to as "mold opening and closing directions a—a'").

Through-holes 11 and 12 are formed in the movable die 3 and the movable holder 4, respectively, in alignment with the axis of the floating core 10. A driving rod 13 is slidably fitted in the through-holes 11 and 12 for purposes of pushing (or pulling) the floating core 10.

A cylinder mounting board 14 is secured to the movable holder 4 with socket screws (not shown). A floating-core driving mechanism 23 is provided on the board 14. The driving mechanism 23 is formed by a cylinder 15 secured to the board 14, and the rod 13 which is screwed into output shaft 15*a* of the cylinder 15. When the cylinder 15 is slid in the mold opening and closing directions a—a', the rod 13 slides with the cylinder.

The floating core 10 consists of a body part 10*a* and a casting shaping part 10*b*. The body part 10*a* is dimensioned so that there is a small gap between the outside surface of the body part 10*a* and the through-hole 9 to allow the floating core 10 to slide. The shaping part 10*b* is shaped for forming an as-cast hole 17 in the casting 1*b*, with a central axis of the hole 17 being parallel to the mold opening and closing directions a—a'. The length of the floating core 10 is such that, when the mold is closed (FIG. 3), the core 10 is held between the inner wall 1*a* of the stationary die 1 and the protrusion 3*a* of the movable die 3 with a small clearance between the floating core 10 and the end face of the rod 13.

Figure 1A:
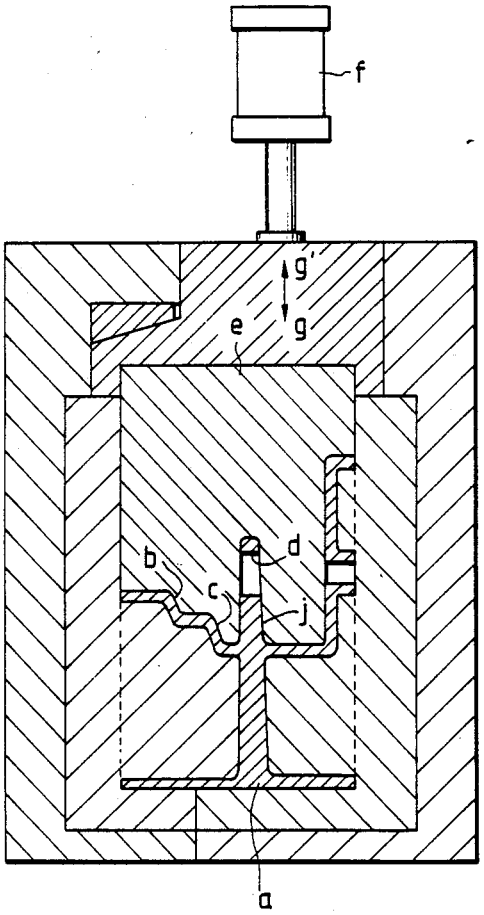
FIGS. 1(*a*), 1(*b*) and 2 are vertical sectional views showing examples of respective different proposed apparatus for forming an as-cast hole by using a core.
Figure 1B:
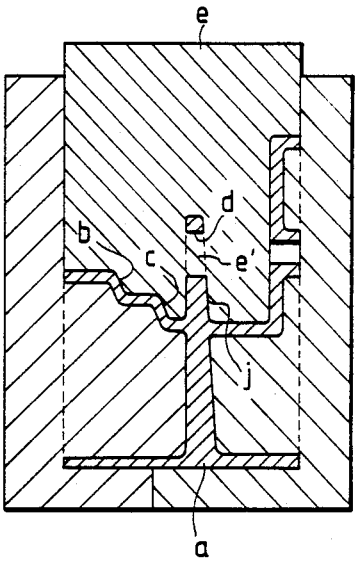
Figure 2:
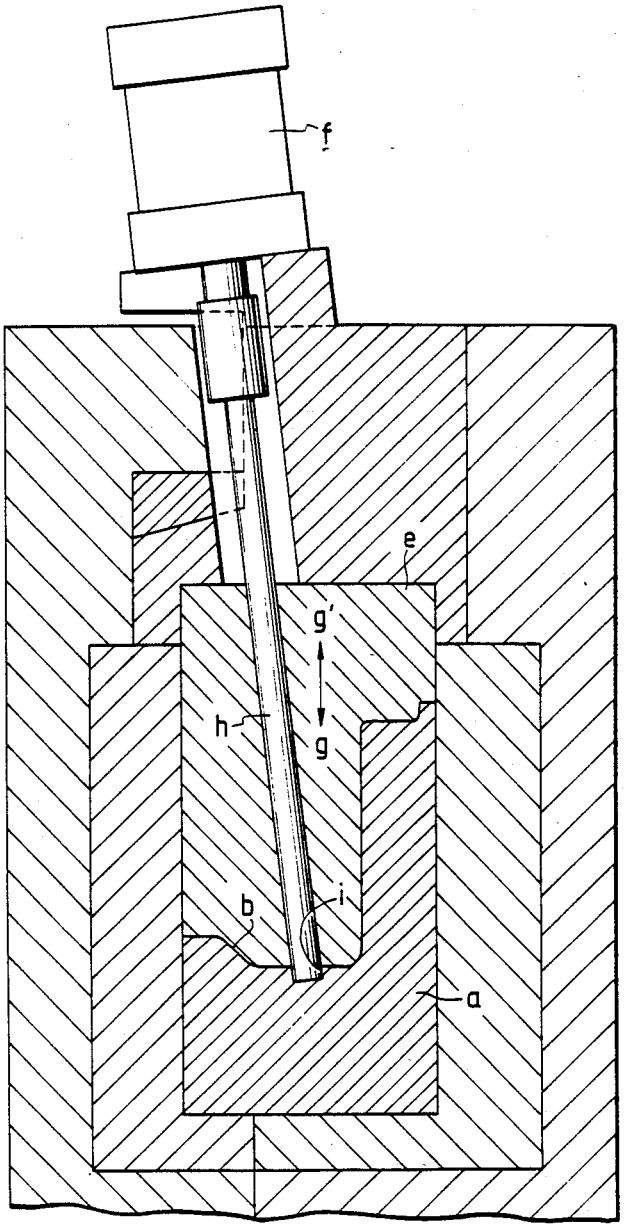

The core die 8 has a shaping part 8*a* at the front end to form an undercut 18 in the casting 16. In addition, or instead, the core die 8 may have a shaping part for an as-cast hole such as the as-cast hole i (FIG. 2) described in the Background Of The Invention section.

In the above-described embodiment, the respective directions of movements of the core die 8 and the floating core 10 are normal; however, these directions can be at any transverse relationship. Furthermore, only one floating core 10 is employed; however, it is evident that a plurality of floating cores may be used.

The apparatus further includes pushing pins 19 which are secured to a pin board 21. The pins 19 can be slidably pushed into cavity 20 of the mold via aligned through-holes in the movable die 3, the movable holder 4 and the board 14 by means of a hydraulic cylinder or the like (not shown) to push the casting 1*b* out of the cavity 20. In the drawings, element 22 is a spacer.

The operation of the apparatus thus constructed will now be described.

When the mold is closed (FIG. 3), the floating core 10 is positively held between the inner wall 1*a* of the stationary die 1 and the end face of the protrusion 3*a* of the movable die 3.

Under this condition, a casting operation is carried out with die-cast alloy ADC 10 under the following casting conditions;

Mold temperature—200° C.; Molten metal temperature—680° C.; Casting pressure—800 kg/cm$^2$; Casting speed—40 m/sec; and Chill time—20 sec.

A predetermined period of time after the molten metal is solidified, the mold is opened by moving the holder 4 in the direction a'. At the same time, the cylinder 15 is operated to slide the driving rod 13 forward (in direction a). As shown in FIG. 4, pushing the rod 13 forward separates the floating core 10 from the casting 1*b*, and opening the mold separates the casting 1*b* from the stationary die 1.

Figure 5:
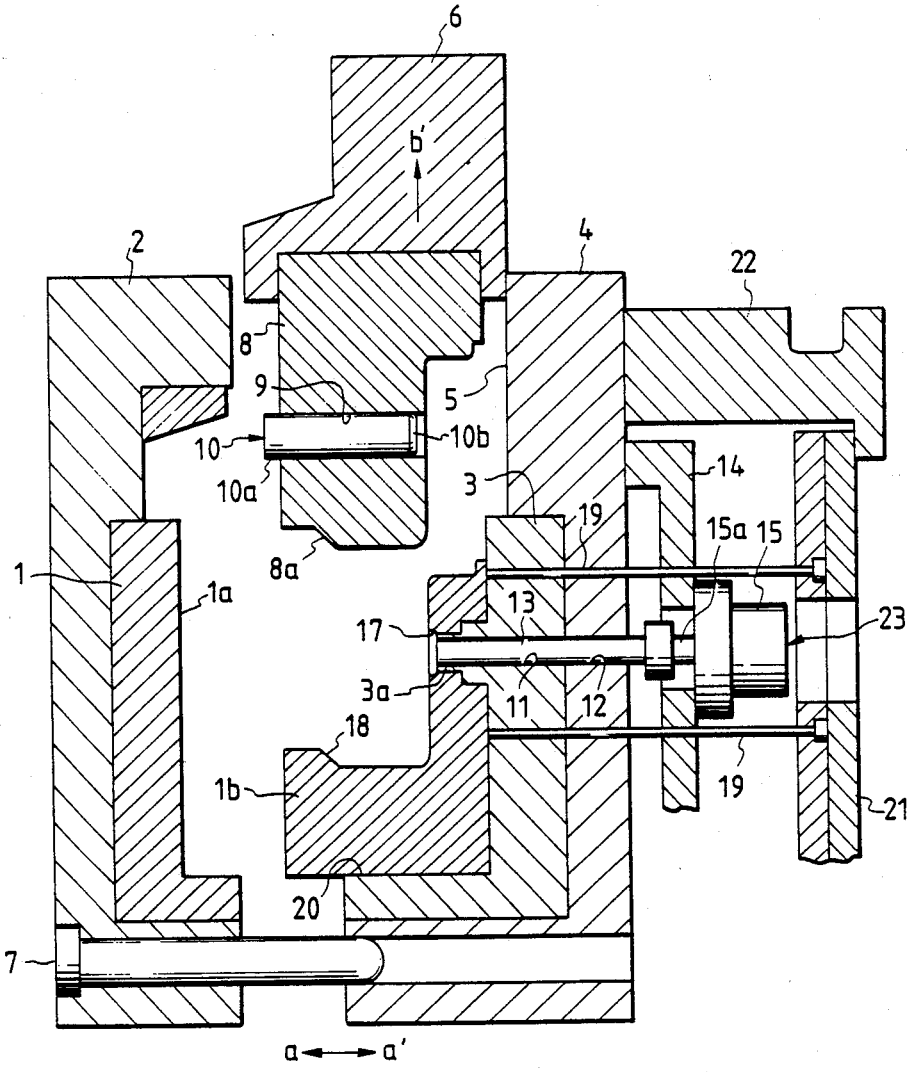
FIG. 5 is a vertical sectional view showing the state of the apparatus when, after the mold is opened, a core holder and a core die are retracted.

Thereafter, the cylinder 15 is operated to retract the rod 13 from the floating core 10 (See FIG. 5). Under this condition, the core holder 6 and the core die 8 are moved in the direction of the arrow b'. The floating core 10 moves together with the core die 8.

Next, using the pins 19, the casting 1*b* is pushed away from the movable die 3 and out of the mold. Thus, the casting 1*b* is manufactured.

To close the mold, first the core holder 6 and the core die 8 are moved in the direction of the arrow b. Then, the mold is closed by moving the holder 4 in the direction a. As a result, the floating core 10 is set in the position shown in FIG. 3 in which the core 10 abuts the inner wall 1*a* of the stationary die 1.

Multiple castings having the as-cast hole 17 and the undercut 18 can be manufactured by repeatedly carrying out the above-described operations.

Thus, according to the invention, the undercut 18 which projects from the casting 1*b* in the b' direction in which the core die 8 is slidable, and the as-cast hole 17 extending at a right angle (or other angle) in relation to the direction b' can be formed simultaneously. This result is achieved by use of the core die 8 slidable in the directions b—b' and the floating core 10, which is fitted in the core die 8 in such a manner that it is slidable in transverse directions (a—a') to the directions b—b'.

Thus, the method of the invention can manufacture the casting 1*b* on a large scale with the as-cast hole 17 and the undercut 18, while achieving high quality without defects such as cavities therein. Moreover, the apparatus of the invention, which is simple in construction, can manufacture the casting 16 at low cost.

An apparatus for manufacturing a casting by using a core according to a second embodiment of the invention will be described with reference to FIGS. 6–8.

Figure 6:
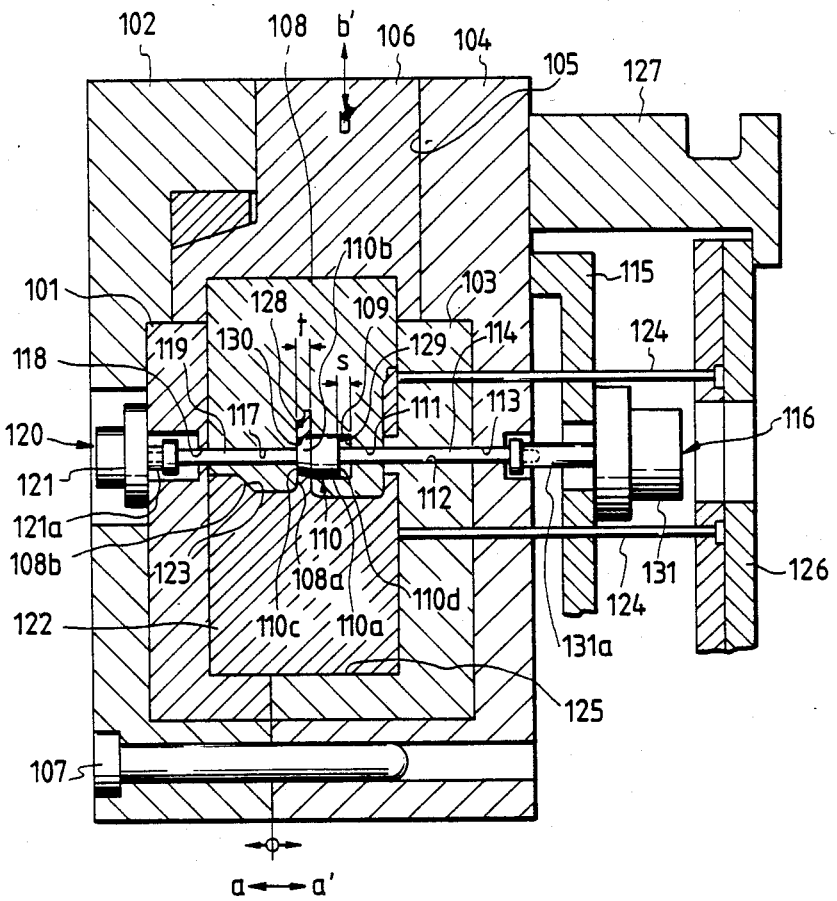
FIG. 6 is a vertical sectional view showing an example of an apparatus for forming an as-cast hole by using a core according to a second aspect of the invention, in which view the mold is closed.
Figure 7:
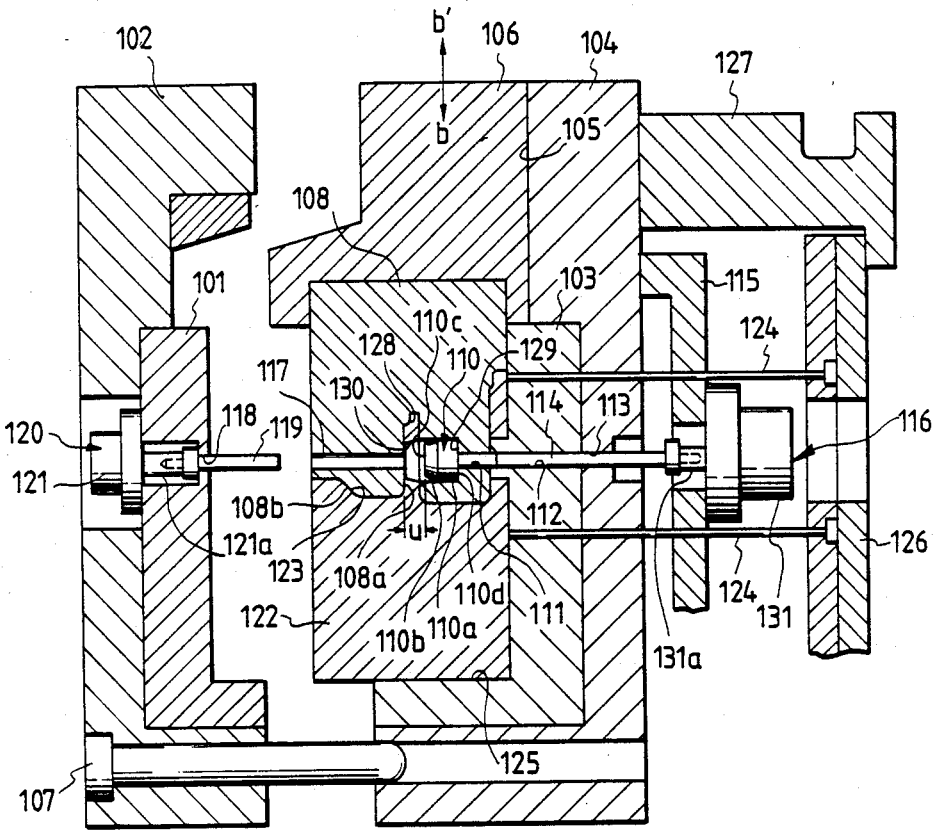
FIG. 7 is a vertical sectional view showing the state of the apparatus when the mold is opened.
Figure 8:
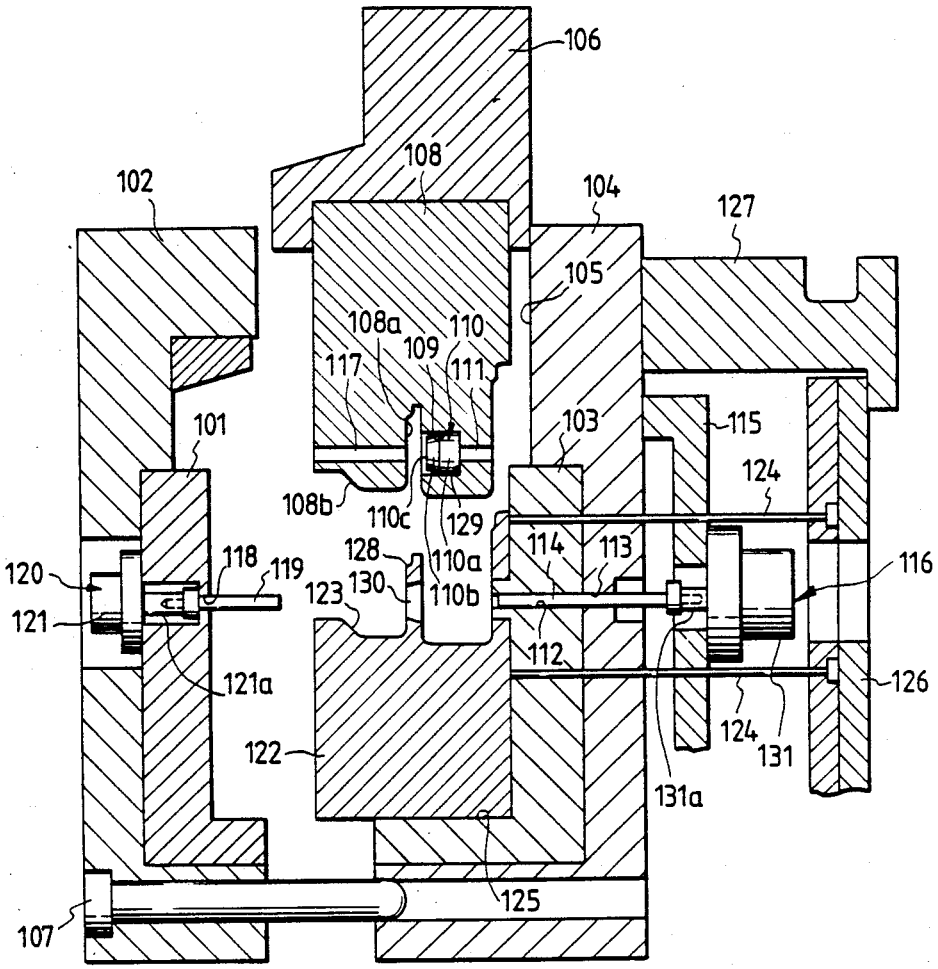
FIG. 8 is a vertical sectional view showing the state of the apparatus when, after the mold is opened, a core holder and a core die are retracted.

As shown in FIGS. 6–8, a stationary die 101 is embedded in a stationary holder 102 and secured with socket screws (not shown), and a movable die 103 is similarly embedded in a movable holder 104 and secured with socket screws (not shown).

A groove 105 formed in the movable holder 104 extends in a direction perpendicular to the mold opening and closing directions a—a' and communicates with the movable die 103. A core holder 106 is fitted in the groove 105 for slidable movement in the directions of the arrow b—b'.

The movable holder 104 is slidably mounted on a plurality of guide pins 107, which extend from the stationary holder 102, for movement towards or away from the stationary holder 102, in the directions a—a'. A hydraulic cylinder or the like (not shown) can be used to move the holder 104 to close or open the mold in a conventional manner, as in the first embodiment.

A core die 108 is fixedly secured to the front end of the core holder 106 with socket screws (not shown). The core die 108 has a laterally directed recessed hole 109 which extends in a direction normal to the arrow b—b'. Two through-holes 111 and 117 are formed in the core die 108 on both sides of the recessed hole 109 and communicate therewith. A floating core 110 is fitted in the recessed hole 109 for slidable movement in the directions of the arrow a—a'.

Through-holes 112 and 113 are formed in the movable die 103 and holder 104, respectively, in alignment with the through-hole 111 in the core die 108. A first driving rod 114 is slidably inserted in the through-holes 111, 112 and 113 to push (or pull) the floating core 110.

A cylinder mounting board 115 is secured to the movable holder 104 with socket screws (not shown). A first driving mechanism 116 for the floating core 110 is provided on the board 115. The driving mechanism 116 is constructed as follows: A cylinder 131 is secured to the board 115 with socket screws (not shown). The first rod 114 is screwed into an output shaft 131*a* of the cylinder 131 so that the rod 114 together with the cylinder 131 is slidably movable in the mold opening and closing directions a—a'.

A through-hole 118 is formed in the stationary die 101 with its axis in alignment with the slide direction of the floating core 110. A second driving rod 119 is slidably inserted in the through-holes 117 and 118 with a small clearance between the end face of the second rod 119 and the front end face 110*c* of the floating core 110.

A second driving mechanism 120 for the floating core 110 is provided at the stationary die 101. The driving mechanism 120 is constructed as follows: A cylinder 121 is fixedly secured to the stationary die 101 with socket screws (not shown). The other end portion of the second rod 119 is screwed into the output shaft 121*a* of the cylinder 121 so that the second rod together with the cylinder 121 can be moved in the mold opening and closing directions a—a'.

The floating core 110 consists of a body part 110*a* and a casting shaping part 110*b*. The floating core 110 is shaped as follows: The outside diameter of the body part 110*a* is slightly smaller than the inside diameter of the recessed hole 109 to form a small clearance therebetween which allows the floating core to satisfactorily slide in the recessed hole. The shaping part 110*b* is, for instance, gradually tapered towards the front end from the body part 110*a* so that an as-cast hole 130 can be formed with its axis parallel to the mold opening and closing directions a—a'. The tapering also enables the floating core to be readily disengaged from the as-cast hole 130 using the second driving mechanism 120, after formation of the casting.

When the mold is closed (FIG. 6), the floating core 110, is pushed by the first driving mechanism 116 until the front end face 110*c* abuts the wall 108*a* of the core die 108, as a result of which the gap s formed between the rear end face 110*d* of the floating core and the bottom 129 of the recessed hole 109 is larger by a predetermined dimension (for instance 1 to 2 mm) than the wall thickness t of a protrusion 128 from the casting 122.

The core die 108 has a shaping part 108*a* for forming an undercut 123 in the casting 122. In addition, the core die 108 may have a shaping part for forming an as-cast hole such as the as-cast hole i (FIG. 2) described in the Background Of The Invention section.

In the above-described embodiment, the core die 108 is normal to the floating core 110; however, it may form an angle other than a right angle. Furthermore, in the above-described embodiment, only one floating core is employed; however, a plurality of floating cores may be used.

The apparatus further includes pushing pins 124 which are fixedly secured to a pin board 126. The pins 124 can be slidably pushed into the cavity 125 of the mold through aligned holes in the movable die 103, the movable holder 104 and the board 105 by means of a hydaulic cylinder or the like (not shown) to push the casting 122 out of the cavity 125. A spacer 127 is also provided.

The operation of the apparatus thus constructed will be described. When the mold is closed (FIG. 6), the floating core 110 is abutted against the wall 108*a* of the core die 108 by extending the first rod 114. In this state, there is a small gap u between the front end face 110*c* of the floating core 110 and the end face of the second rod 119.

With the mold closed, a casting operation is carried out with die-cast alloy ADC 10 under the following casting conditions:

Mold temperature—200° C.; Molten metal temperature—680° C.; Casting temperature—800 kg/cm²; Casting speed—40 m/sec; and Chill time—20 sec.

A predetermined period of time after the molten metal is solidified, the cylinder 131 is operated to retract the first rod 114. Then, the cylinder 121 is operated to extend the second rod 119. That is, both rods are moved in the direction a', as a result of which the floating core 110 is withdrawn from the casting and moved against the bottom 129 of the recessed hole 109. Under this condition, the mold is opened, as shown in FIG. 7. Thereafter, the core holder 106 and die 108 are moved in the direction b'. In this operation, the floating core 110 is moved together with the core 108, as shown in FIG. 8. The casting 122 is then pushed out using the pushing pins 124. Thus, the casting 122 has been manufactured.

To close the mold, the core holder 106 and die 108 are first moved in the direction b, and then the holder 104 is moved in the direction a.

With the mold closed, the cylinder 121 is operated to retract the second rod 119, and then the cylinder 131 is operated to extend the first rod 114 to move the floating core 110 into the position shown in FIG. 6.

The casting can be mass-produced by repeatedly carrying out the above-described operation.

Thus, according to the invention, the undercut 123 in the slide directions b—b' of the core die 108 and the as-cast hole 130 normal to, or at an angle other than a right angle with, the slide directions b—b' can be formed simultaneously. The invention achieves this simultaneous formation by using the core die 108 and the floating core 110 slidably disposed therein, e.g., for movement in a direction perpendicular to (or at some other angle with) the slide directions b—b'.

Thus, the apparatus of the invention, which is relatively simple in construction, can manufacture a casting with high efficiency, which casting has an as-cast hole (130) and an undercut (123) and is high in quality, without defects such as cavities.

What is claimed is:

1. An apparatus for forming a casting (1*b*) with an as-cast hole (17), the apparatus comprising:

a mold comprising a stationary die (1), a movable die (3), and a core die (8) for forming a cavity;

means for opening and closing said mold by moving said movable die in first and second opposite directions (a',a), respectively; and means for moving said core die in third and fourth opposite directions (b',b), wherein said core die has front and side surfaces for forming said cavity and has a hole (9) formed therein, and said mold further comprises a floating core (10) disposed in said hole for movement with respect to said core die in fifth and sixth opposite directions which are transverse to said third and fourth directions.

2. The apparatus of claim 1, wherein said floating core is shaped for forming said as-cast hole which has an axial direction parallel to said fifth and sixth directions.

3. The apparatus of claim 2, wherein said floating core (10) consists of a body part (10*a*) penetrating said hole (9) and a casting shaping part (10*b*) projecting from said hole (9), wherein the outside diameter of said body part (10*a*) is formed so as to form a small clearance between said body part (10*a*) and said hole (9) which allows said floating core (10) to satisfactorily slide in said hole (9).

4. The apparatus of claim 3 further comprising drive means (23) for selectively moving said floating core (10) in said fifth and sixth directions.

5. The apparatus of claim 3, wherein said floating core has a length extending longitudinally in such a manner that said floating core is positively held between said stationary die (1) and said movable die (3) when said mold is closed.

6. The apparatus of claim 1, wherein said floating core (110) is slidably fitted in a recessed hole (109) formed in said core die (108) in said fifth and sixth directions in such a manner that said floating core is slided and held by two drive mechanisms symmetrically provided at both sides of said floating core.

7. The apparatus of claim 6, wherein said floating core (110) consists of a body part (110*a*) and a casting shaping part (110*b*) wherein said outside diameter of said body part (110*a*) is slightly smaller by a predetermined dimension than the inside diameter of said recessed hole (109).

8. The apparatus of claim 7, wherein the formed casting includes a protrusion having a wall thickness (t), and wherein a length of said recessed hole (109) is formed in such a manner, that said length of said recessed hole relative to a length of said floating core is longer by a predetermined dimension than the wall thickness (t) of said protrusion from said casting.

9. The apparatus of claim 1, wherein said fifth and sixth directions are substantially normal to said third and fourth directions.

10. The apparatus of claim 1, wherein said first and second directions are substantially normal to said third and fourth directions.

11. A method of forming a casting with an as-cast hole comprising the steps of:

preparing a mold by moving a core die for forming at least one of an undercut and an as-cast hole in said casting, said core die being moved in a first direction, by moving a movable die in a second direction toward a stationary die to close said mold, and by moving a floating core, movably disposed in said core die, for forming another as-cast hole, said floating core being moved relative to said core die in a third direction transverse to said first direction; and removing said casting from said mold.

12. The method of claim 11, wherein said first and third directions are substantially normal.

13. The method of claim 11, wherein said first and second directions are substantially normal.

* * * * *